US006478551B1

(12) United States Patent
Nonaka

(10) Patent No.: US 6,478,551 B1
(45) Date of Patent: Nov. 12, 2002

(54) GAS COMPRESSOR HAVING ENLARGED DISCHARGE CHAMBER

(75) Inventor: Takeshi Nonaka, Narashino (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/495,276

(22) Filed: Jan. 31, 2000

(51) Int. Cl.[7] ..... F04B 39/00; F04B 17/00; F04B 23/04; F04B 19/24

(52) U.S. Cl. ..... 417/313; 417/410.3; 417/62; 417/209; 417/DIG. 1

(58) Field of Search ..... 417/410.3, 62, 417/313; 418/DIG. 1, 209, 199; 55/319, 320

(56) References Cited

U.S. PATENT DOCUMENTS

| | | | | | |
|---|---|---|---|---|---|
| 1,752,093 | A | * | 3/1930 | King | 418/89 |
| 2,013,777 | A | * | 9/1935 | Dennedy | 230/152 |
| 3,776,668 | A | * | 12/1973 | Abendschein | 418/97 |
| 3,825,372 | A | * | 7/1974 | Lundberg et al. | 417/321 |
| 4,035,114 | A | | 7/1977 | Sato | 418/84 |
| 4,205,537 | A | * | 6/1980 | Dubberley | 65/510 |
| 4,478,054 | A | | 10/1984 | Shaw et al. | 62/323.4 |
| 4,913,634 | A | * | 4/1990 | Nafata et al. | 418/47 |
| 5,112,201 | A | * | 5/1992 | Tamura et al. | 417/366 |
| 5,211,031 | A | | 5/1993 | Murayama et al. | 62/498 |
| 5,542,266 | A | | 8/1996 | Suzuki et al. | 62/469 |
| 5,733,107 | A | * | 3/1998 | Ikeda et al. | 417/312 |

FOREIGN PATENT DOCUMENTS

| | | | | |
|---|---|---|---|---|
| EP | 0201672 | | 11/1986 | |
| EP | 0538973 | | 4/1993 | |
| EP | 0738859 | | 10/1996 | |
| JP | 59-99079 | * | 7/1984 | F04B/39/04 |

OTHER PUBLICATIONS

Patent Abstracts of Japan, vol. 008, No. 210 (M–328), Sep. 26, 1984, publication No. 59099079, publication date Jun. 7, 1984.

Patent Abstracts of Japan, vol. 016, No. 353 (M–1288), Jul. 30, 1992, publication No. 04109090, publication date Apr. 10, 1992.

* cited by examiner

*Primary Examiner*—Cheryl J. Tyler
*Assistant Examiner*—Timothy P. Solak
(74) *Attorney, Agent, or Firm*—Adams & Wilks

(57) ABSTRACT

An air conditioning compressor is equipped with an oil separator for separating high-pressure refrigerant gas and lubrication oil into a gas component and an oil component. The compressor's casing has a barrel portion surrounding an outer portion of the compressor and an enlarged case potion extending from the barrel portion. The enlarged case portion has a discharge chamber disposed between an inner surface of the casing and a rear portion of the compressor for temporarily holding the gas component and the oil component. An oil sump within the discharge chamber is dimensioned to store a sufficient amount of the oil component to suppress an increase in the oil circulation ratio of an air conditioning system while maintaining a sufficient amount of the lubrication oil in the compressor casing to lubricate the compressor.

18 Claims, 9 Drawing Sheets

RELATIONSHIP BETWEEN TEMPERATURE AND PRESSURE DUE TO DIFFERENCES IN COMBINATION OF THE REFRIGERANT GAS AND OIL WHEN THE REFRIGERANT GAS IS DISSOLVED INTO THE OIL BY 10%

GAS COMPRESSOR HAVING ENLARGED DISCHARGE CHAMBER

BACKGROUND OF THE INVENTION

1. Field of the Invention

The present invention relates to a gas compressor used in an air conditioning system and more particularly to a gas compressor that may enhance the refrigeration efficiency in the air conditioning system and may prevent the lubrication fault caused by oil shortage.

2. Description of the Related Art

As shown in FIG. 8, conventionally, in such a kind of the gas compressor, a compressor body 4, an oil separator 5 and the like are received in a casing 3 composed of a case 1 opened at one end and a front head 2 mounted on the open end. A space formed between the inside of the casing 3 and the front portion of the compressor body 4 is formed as a suction chamber 6, and a space formed between the inside of the casing 3 and the rear portion of the compressor body 4 is formed as a discharge chamber 7.

When a rotor 4*b* is rotated together with a rotor shaft 4*a*, the compressor body 4 sucks low pressure refrigerant gas from the suction chamber 6 into a cylinder 4*d* through a front side block 4*c*, compresses the low pressure refrigerant gas together with lubricant oil and discharges from a rear side block 4*e* toward the discharge chamber 7. Also, the oil separator 5 is mounted on the rear side block 4*e* of the compressor body 4 for separating high-pressure refrigerant gas, discharged from the compressor body 4 toward the discharge chamber 7, into a gas component and an oil component. The thus separated gas component passes from the discharge chamber 7 through a discharge port 7*a* of the case 1, a condenser 9 of an air conditioning system 8 shown in FIG. 9, an expansion valve 10, an evaporator 11 and the like and thereafter is returned to the suction chamber 6 from a suction port 6*a* to be again compressed together with the oil as the refrigerant gas. On the other hand, the oil component is temporarily reserved in an oil pool 7*b* at the bottom portion of the discharge chamber 7 and is again compressed together with the refrigerant gas.

However, in such a conventional gas compressor, although the high-pressure refrigerant gas discharged from the compressor body 4 is fed into the oil separator 5, it is difficult to completely separate the high-pressure refrigerant gas into the gas component and the oil component by the oil separator. As a result, the oil component that could not be completely separated (hereinafter also referred to as "non-separated oil component") is caused to flow as a mist oil to the condenser 9 of the air conditioning system 8, the evaporator 11 and the like so that the oil circulation ratio (hereinafter also referred to as OCR) of the air conditioning system 8 is high and a large amount of the oil that inherently has nothing to do with the refrigeration is recirculated within the air conditioning system 8 to degrade the refrigeration efficiency. Also, when the oil component is caused to flow toward the condenser 9 of the air conditioning system 8, the amount of oil within the gas compressor is reduced to cause such a problem that the lubrication fault of the gas compressor due to the oil shortage would occur. Furthermore, in order to separate the gas component and the oil component of the refrigerant gas at a higher ratio, it is possible to consider using the combination in which the refrigerant gas and the oil are hardly mixed with each other. However, the oil that has been discharged from the gas compressor is cooled within the evaporator 11 and the like and the viscosity of the oil is increased so that the oil will not return to the gas compressor. Thus, there is a problem that the lubrication fault of the gas compressor due to the oil shortage would occur.

SUMMARY OF THE INVENTION

In order to overcome the above-noted defects inherent in the prior art, an object of the present invention is to provide a gas compressor that is suitable for enhancement of the refrigeration efficiency of an air conditioning system and to prevent the lubrication fault due to the oil shortage.

In order to attain the above-mentioned objects, according to the invention, there is provided a gas compressor comprising: a compressor body for compressing a refrigerant gas in a suction chamber together with oil for lubrication and for discharging this to the side of a discharge chamber; and an oil separator for separating high-pressure refrigerant gas discharged from the compressor body into a gas component and an oil component, in which the gas component returns to the suction chamber from the discharge chamber through a condenser or the like of an air conditioning system to be compressed again together with oil as the refrigerant gas, and the oil component is temporarily reserved in an oil pool of the bottom portion of the discharge chamber to be compressed again together with the refrigerant gas, characterized in that a space volume is enlarged enough to suppress an oil circulation ratio of the air conditioning system and to keep a sufficient amount of oil within the gas compressor body.

According to the present invention, there are provided a casing for receiving the compressor body and the oil separator. A space defined between the inside of the casing and the front portion of the compressor body is formed into a suction chamber, and a space defined between the inside of the casing the rear portion of the compressor body is formed into a discharge chamber. The space volume of the above-described discharge chamber is enlarged by projecting the inside of the casing to the outside.

According to the present invention, there is provided a gas compressor comprising a plurality of compressor bodies and a single discharge chamber, in which the refrigerant gas in each suction chamber is compressed together with the oil for every respective compressor bodies to be discharged to the single discharge chamber by separating this into a gas component and an oil component, the gas component returns to the suction chamber from the single suction chamber through the condenser or the like of the air conditioning system to be compressed again as the refrigerant gas together with the oil, and the oil component is temporarily reserved in the oil pool of the bottom portion of the discharge chamber to be compressed again together with the refrigerant gas, characterized in that a space volume of the single discharge chamber is enlarged enough to suppress an oil circulation ratio of the air conditioning system and to keep a sufficient amount of oil within the gas compressor body.

The gas compressor according to the invention is characterized in that the discharge chamber has a space volume that is two times to ten times larger than a sucked gas displacement per one revolution of the compressor body.

The gas compressor according to the invention is characterized in that the single discharge chamber has a space volume that is ten times to thirty times larger than a sucked gas displacement per one revolution of a plurality of body.

The gas compressor according to the invention is characterized in that the combination of the oil and the refrigerant gas is one selected from a group essentially consisting of PAG system oil and R22 refrigerant, PAG system oil and R407C refrigerant, ether system oil and R407C refrigerant, carbonate system oil and R407C refrigerant, carbonate system oil and R410a refrigerant, ester system oil and R410a refrigerant and PAG system oil and R134a refrigerant.

According to the present invention, since the space volume of the discharge chamber is large as described above, the high-pressure refrigerant gas including the oil component (non-separated oil component) that could not be separated by the oil separator is stagnant in the discharge chamber for a long period of time. The ratio of the non-separated oil component to drop by its gravitational force down to the oil pool at the bottom of the discharge chamber to thereby considerably reduce the entrance amount of the non-separated oil component to the condenser, the evaporator and the like of the air conditioning system.

Note that, in the present invention, the oil circulation ratio or OCR means the ratio of the oil component amount relative to the entire amount of the mixture of the refrigerant gas component and the oil component at any desired position within the air conditioning system except for the compressor when a part of the oil filled within the compressor is discharged to the air conditioning system by the operation of the compressor. Also, the sucked gas displacement volume per one revolution of the compressor means, in the structure where the refrigerant gas is compressed by the compressor body due to the rotation of the rotor, a theoretical volume of the sucked gas, to be discharged during one revolution of the rotor, which may be calculated in accordance with a dimension and a structure of the compressor body. The PAG is abridgement of polyalikylene glycol.

DETAILED DESCRIPTION OF THE PREFERRED EMBODIMENTS

Figure 1:
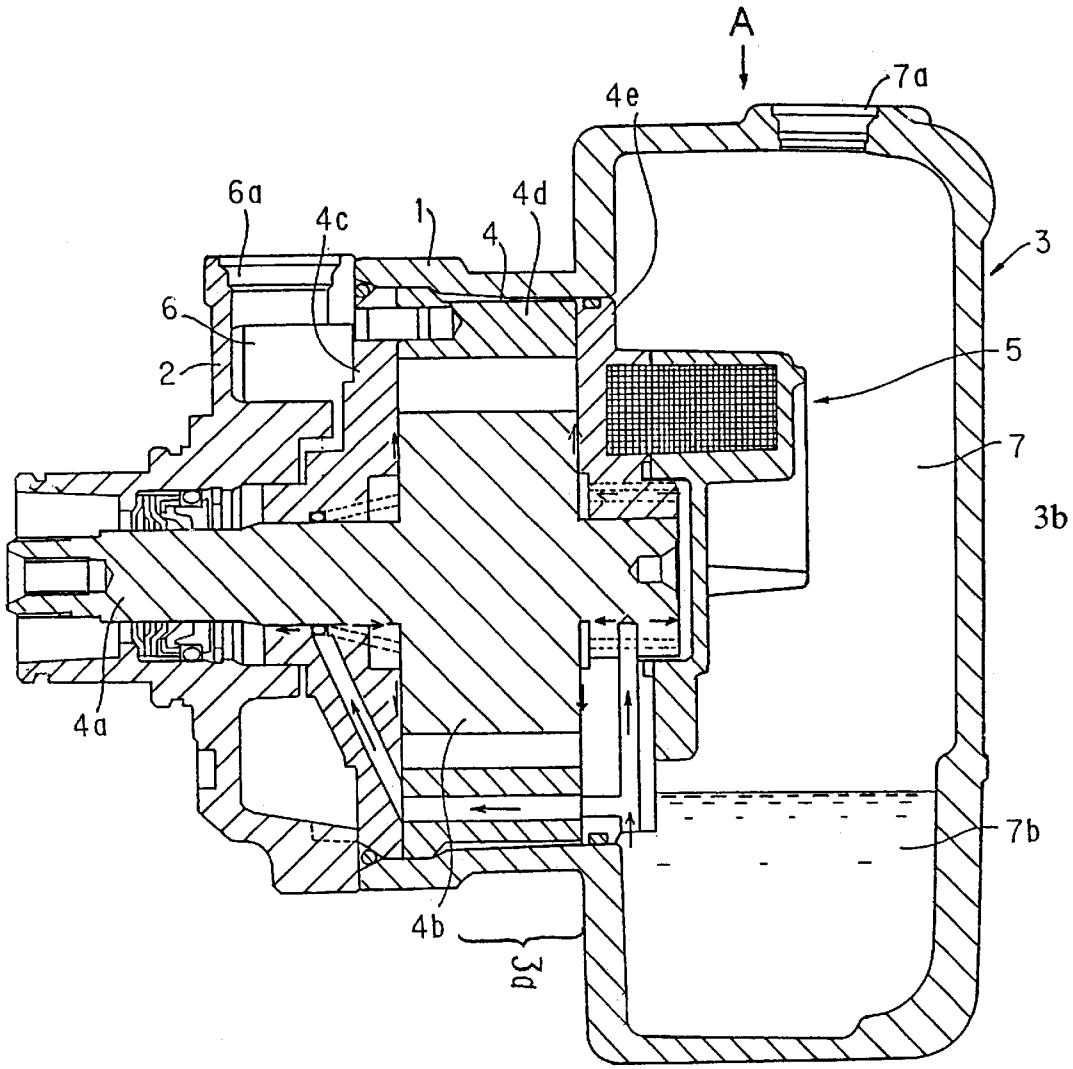
FIG. 1 is a longitudinal sectional view showing a gas compressor in accordance with an embodiment of the present invention (single compressor)

A gas compressor in accordance with an embodiment of the present invention will now be described in detail with reference to FIGS. 1 to 7.

Incidentally, the basic structure of the gas compressor is substantially the same as that of the convention one. Namely, the gas compressor has the compressor body 4, the oil separator 5 and the like. The compressor body 4 compresses the refrigerant gas of the suction chamber 6 together with the lubrication oil and discharges this to the discharge chamber 7. Also, the oil separator 5 separates the high-pressure refrigerant gas, discharged from the compressor body 4, into the gas component and the oil component. Accordingly, the same reference numerals are used to designate the like component and the detailed explanation therefore will be omitted.

Figure 2:
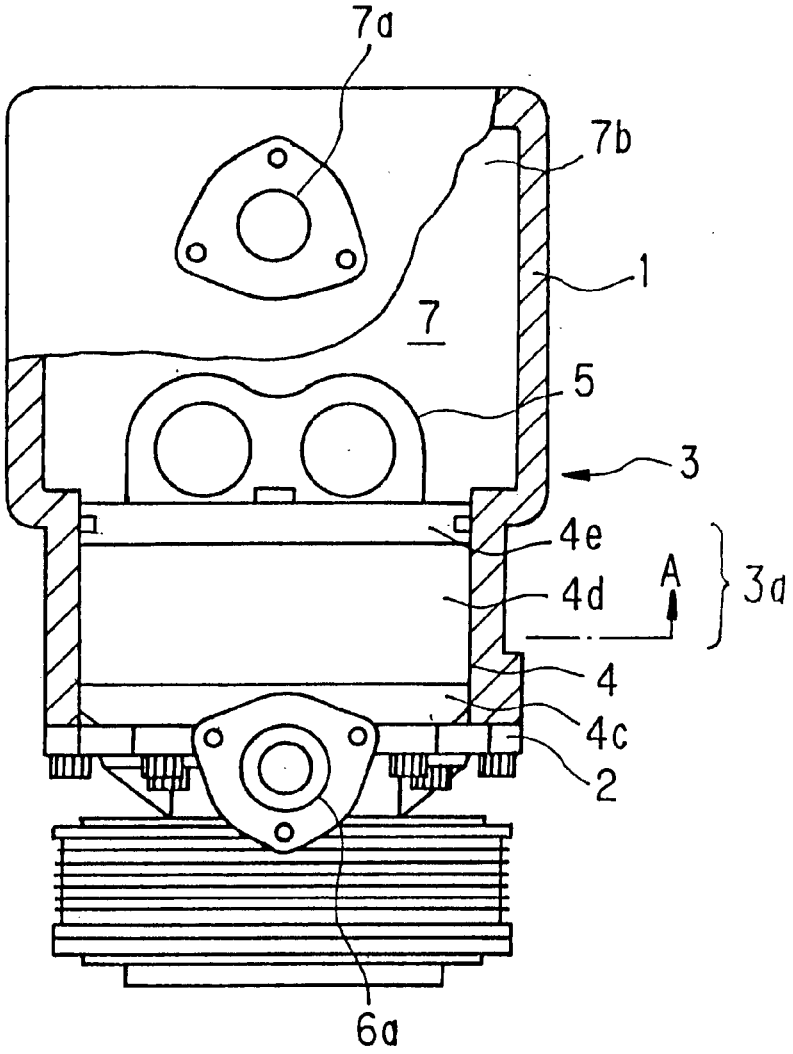
FIG. 2 is a sectional view taken along the line A of FIG. 1.
Figure 8:
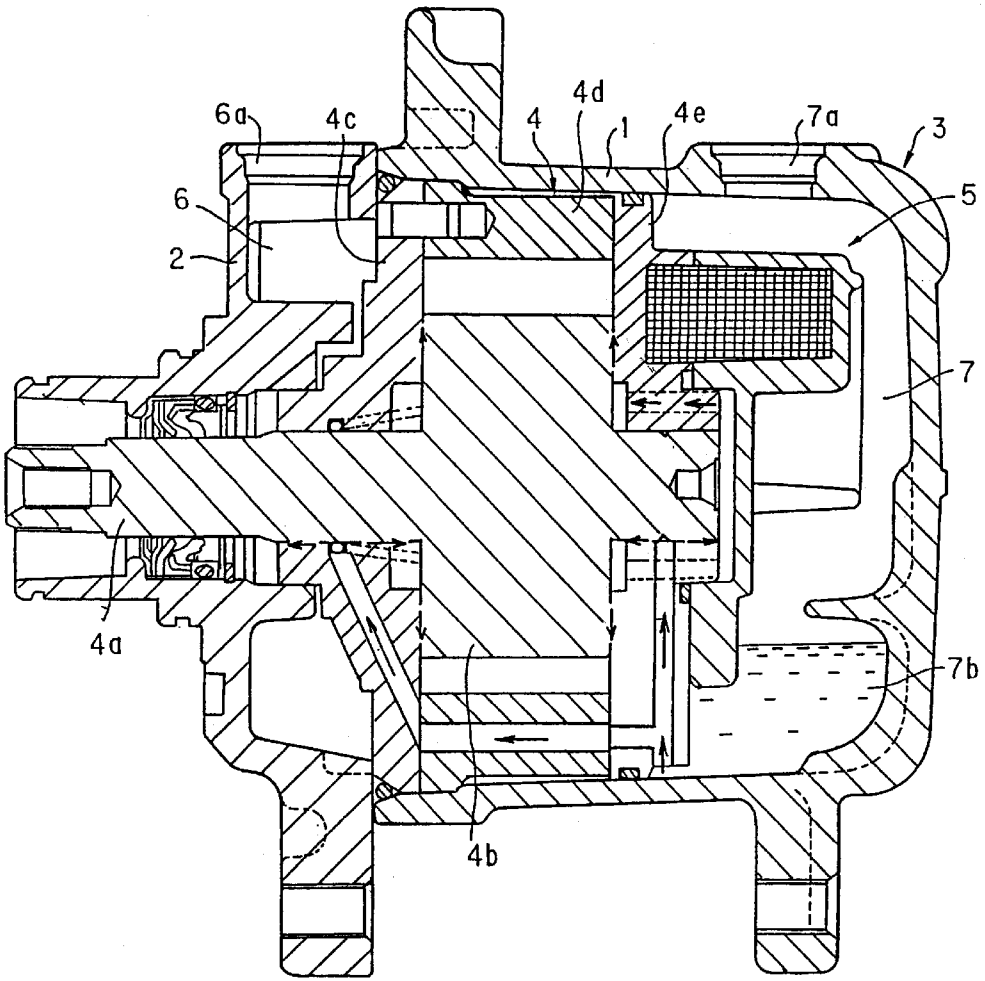
Fig. 8 PRIOR ART
FIG. 8 is a cross-sectional view showing a conventional gas compressor.

In the gas compressor shown in FIGS. 1 and 2, a space volume of the discharge chamber is increased in comparison with the conventional gas compressor (see FIG. 8). The gas compressor is provided with a large volume discharge chamber 7.

More specifically, the gas compressor shown in FIGS. 1 and 2 has a casing 3 for receiving a compressor body 4 and an oil separator 5. The space defined between the inside of the casing 3 and the front portion of the compressor body 4 is formed into the suction chamber 6 and the space defined between the inside of the casing 3 and the rear portion of the compressor body 4 is formed into the discharged chamber 7 as in the conventional compressor. However, in the gas compressor shown in FIG. 1, in order to increase the space volume of the discharge chamber 7 in comparison with the conventional gas compressor, an inside (an inner wall surface on the rear portion of the case body 1) forming the inner wall of the discharge chamber 7 is expanded to the outside as one means for enlarging the volume. This is different from the structure of the conventional compressor. Namely, in the gas compressor shown in FIG. 1, the rear portion of the casing 3 has an outer appearance so that the rear portion of the casing 3 is largely inflated from a barrel portion 3*a* (a waist portion surrounding the outer periphery of the compressor body 4) to form an enlarged case portion 3*b*. The inside of the portion that appears to be inflated is the large volume discharge chamber 7.

Figure 9:
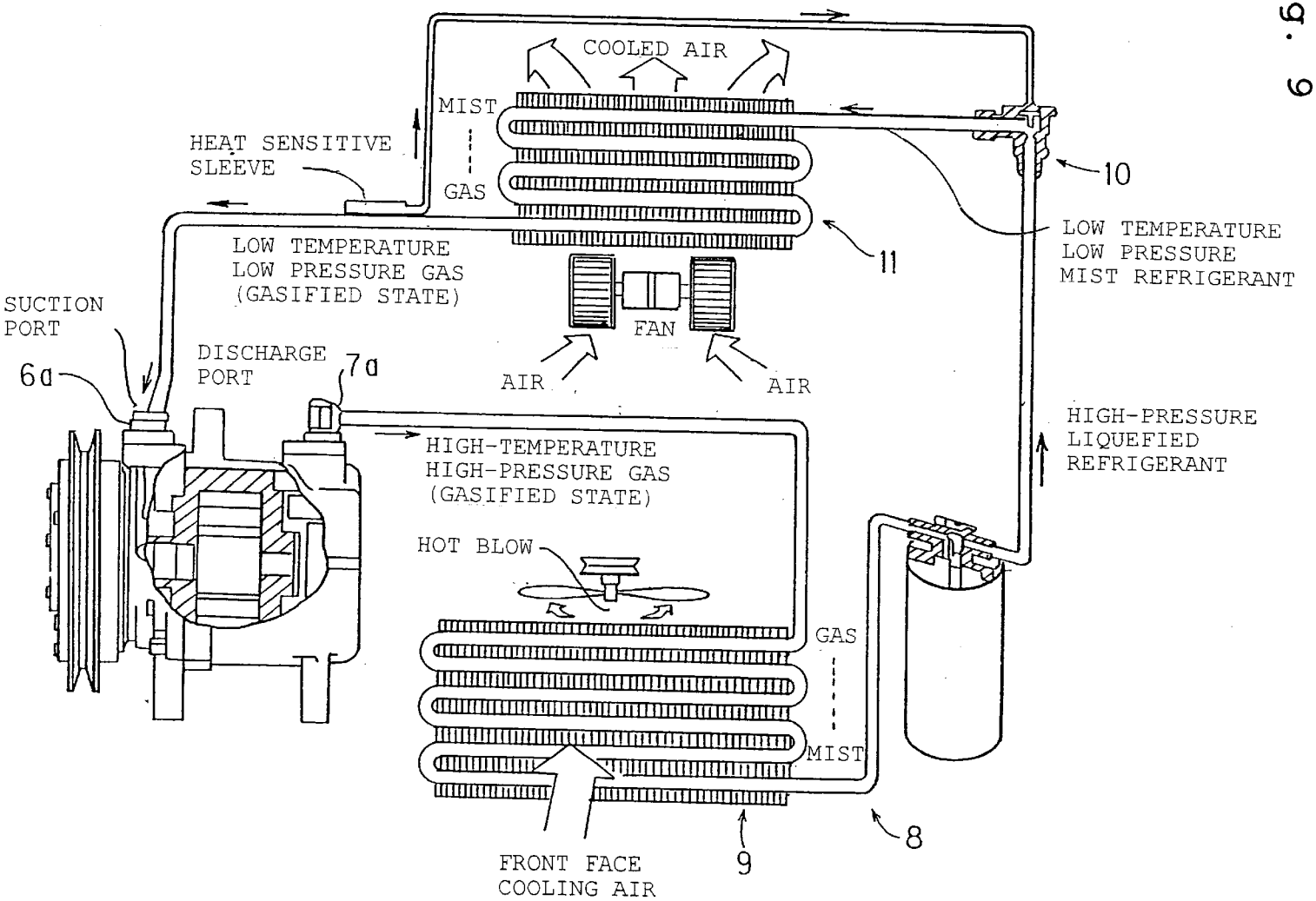
FIG. 9 is an illustration of an air conditioning system.

If the space volume of the discharge chamber 7 is enlarged, the high-pressure refrigerant gas including the non-separated oil component (oil component that could not be separated by the oil separator 5) takes a sufficient time to pass through the discharge chamber 7 and to reach the discharge port 7*a*. If the passage time of the high-pressure refrigerant gas through the discharge chamber is thus elongated, the amount of the non-separated oil component contained in the high refrigerant gas to drop by its gravitational force to the oil sump or pool 7*b* at the bottom portion of the discharge chamber is increased in comparison with the conventional case. It is therefore possible to considerably decrease the entrance amount of the non-separated oil component to the condenser 9 (see FIG. 9) of the air conditioning system 8, and to reserve a sufficient amount of the oil within the gas compressor. The volume of the discharge chamber 7 is increased in comparison with the conventional case so that the volume is enlarged up to a large volume enough to keep a sufficient amount of oil and to reduce the oil circulation ratio within the air conditioning system 8.

The operation of the thus constructed gas compressor will now be described with reference to FIGS. 1 and 2.

Incidentally, the following operation is the same as in the conventional case. Namely, when the operation of the gas compressor is started, the refrigerant gas is sucked into the compressor body 4 from the suction chamber 6, and the sucked refrigerant gas is compressed together with the oil within the compressor body 4 and thereafter discharged toward the discharge chamber 7 as the high-pressure refrigerant gas. Also, the high-pressure refrigerant gas discharged from the compressor body 4 toward the discharge chamber 7 is separated into a gas component and an oil component by the oil separator 5. The gas component passes from the discharge chamber 7 through the discharge port 7*a* of the case 1, the condenser 9 or the like of the air conditioning system 8 and thereafter is returned to the suction chamber 6 from the suction port 6*a* to be again compressed together with the oil as the refrigerant gas. On the other hand, the oil component is temporarily reserved in the oil pool 7*b* at the bottom portion of the discharge chamber 7 and is again compressed together with the refrigerant gas. This operation is substantially the same as that of the conventional case.

Furthermore, in this gas compressor, it is difficult to completely separate the high-pressure refrigerant gas, discharged from the compressor body 4, into the gas component and the oil component by the oil separator 5. The oil component (non-separated oil component) that has not been completely separated is contained in a state of mist oil in the high-pressure refrigerant gas of the discharge chamber 7. However, an amount of the oil that is to flow out toward the condenser 9 (see FIG. 9) of the air conditioning system, out of such a non-separated oil component, is very small, and a large amount of the non-separated oil drops down toward the oil pool 7*b* of the bottom of the discharge chamber 7.

Namely, in the gas compressor shown in FIG. 1, since the space volume of the discharge chamber 7 is increased in comparison with the conventional case, the stagnation time of the high-pressure refrigerant gas including the non-separated oil component in the discharge chamber is elongated in comparison with the conventionally structured gas compressor to be temporarily hold. As a result, a large amount of the non-separated oil component drops down to the oil pool 7*b* at the bottom of the discharge chamber 7 by the gravitational force. For this reason, the flow-out amount of the non-separated component to the condenser 9 of the air conditioning system 8 is largely reduced and the oil circulation ratio of the air conditioning system 8 is lowered. Accordingly, the large amount of the oil that inherently has nothing to do with the refrigeration is prevented from being recirculated through the air conditioning system 8 and it is therefore possible to suppress the oil circulation ratio of the air conditioning system 8 to a lower level to enhance the refrigeration efficiency. Also, a sufficient amount of oil may be reserved in the gas compressor to thereby prevent the lubrication fault of the gas compressor due to the oil shortage.

Incidentally, in the foregoing embodiment, the inside of the casing 3 is largely projected from the barrel portion 3*a* of the casing 3 so that the space volume of the discharge chamber 7 is enlarged. In another method to enlarge the volume of the discharge chamber 7, it is however possible to attain the relative enlargement of the space volume of the discharge chamber 7 by downsizing, for example, the compressor body 4 within the interior of the casing 3 or the like.

Figure 3:
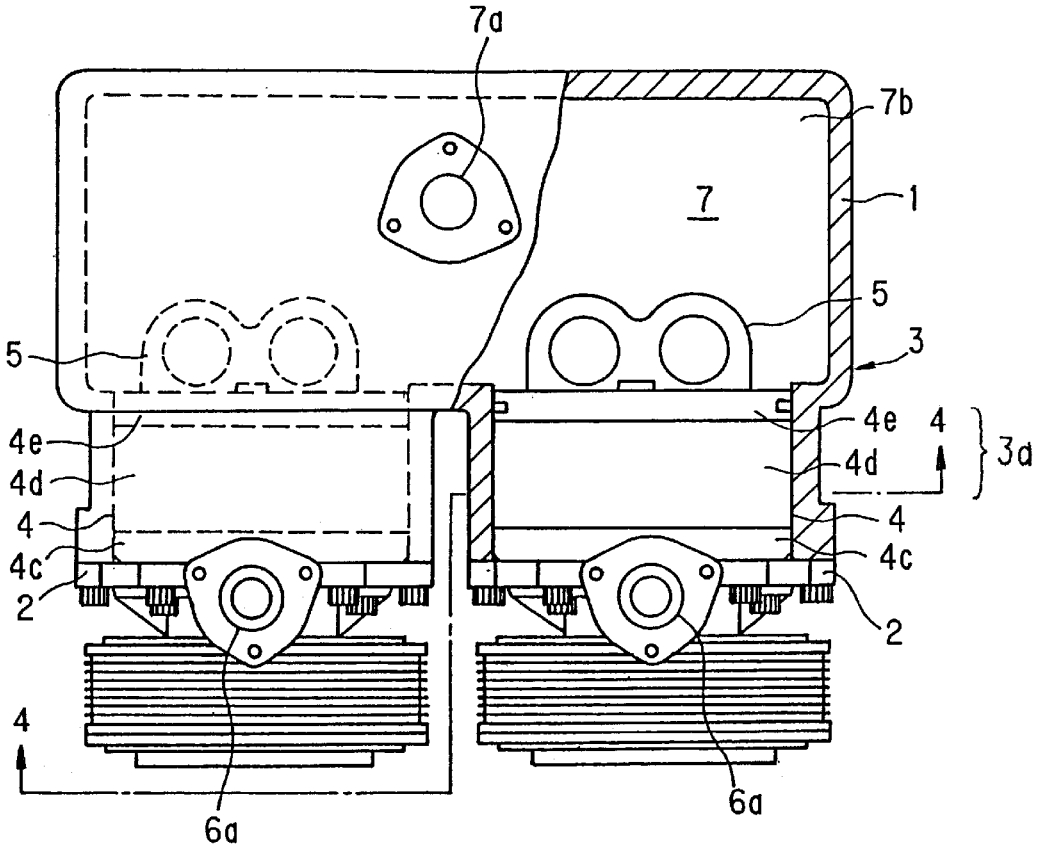
FIG. 3 is a partially fragmentary view of a gas compressor in accordance with another embodiment of the present invention as viewed from above (multi-compressor)
Figure 4:
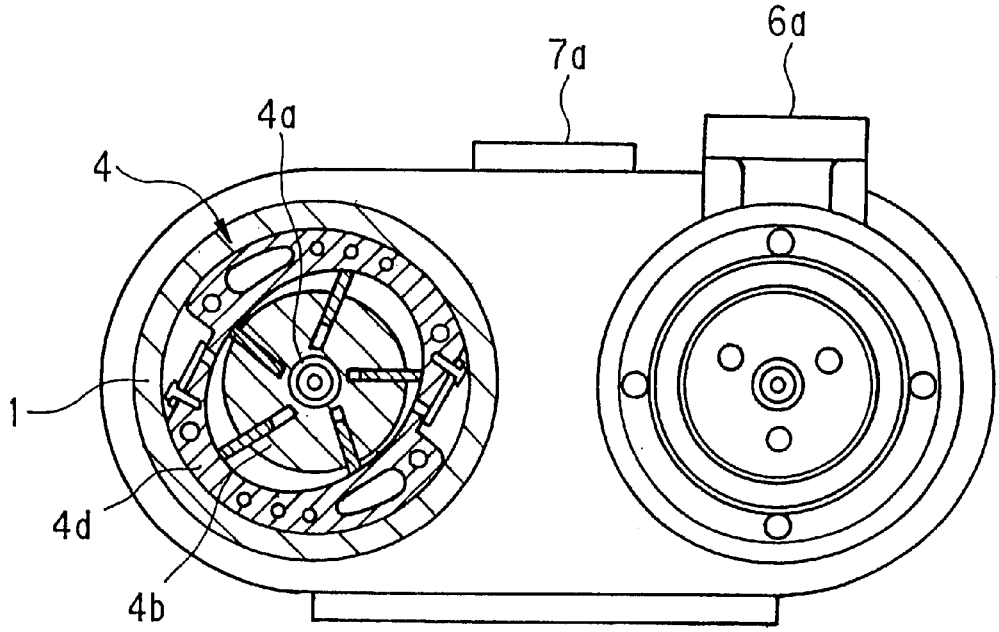
FIG. 4 is a cross-sectional view taken along the line 4—4 of FIG. 3.

FIGS. 3 and 4 show another embodiment of the gas compressor according to the invention. FIG. 4 is a cross-sectional view taken along line 4—4 of FIG. 3. The gas compressor shown in FIG. 3 is of a multi-compressor type that has two compressor bodies 4 and 4, oil separators 5 and 5 provided for each of the compressor bodies 4 and 4 and a single discharge chamber 7 commonly used for the compressor bodies 4 and 4 within the case body 1. Since the basic structure of each compressor body 4, 4 is substantially the same as that of the compressor body 4 (see FIG. 1) in the gas compressor (hereinafter referred to as a single compressor) shown in FIG. 8, the same reference numerals are used to indicate the like components and the detailed explanation therefore will be omitted. Incidentally, the space volume of the discharge chamber 7 in the multi-compressor shown in FIG. 3 corresponds to two discharge chambers 7 for the single compressor.

In the multi-compressor shown in FIG. 3, the refrigerant gas of the suction chamber of each of the compressors 4 and 4 is compressed together with the oil. Then, the compressed high-pressure refrigerant gas is discharged toward the single common discharge chamber 7 after separated into the gas component and the oil component by the oil separators 5 and 5.

Namely, in the multi-compressor shown in FIG. 3, the two compressor bodies 4 and 4 commonly use the single discharge chamber 7 as an object to which the high-pressure refrigerant gas is discharged. In this embodiment, the space volume of such a discharge chamber 7 (hereinafter referred to as a common discharge chamber) becomes large enough to keep a sufficient amount of oil within the gas compressor while reducing the oil circulation ratio of the air conditioning system.

Incidentally, with respect to the gas component contained in the refrigerant gas discharged to the common discharge chamber 7, it passes through the condenser 10 or the like of the air conditioning system 8 and the single discharge port 7*a* of the case 1 in communication with the common discharge chamber 7 and returns to the suction chamber 6 through the suction port 6*a* to be again compressed together with the oil as the refrigerant gas. Also, with respect to the oil component contained in the refrigerant gas discharged to the common discharge chamber 7, it is temporarily reserved in the oil pool 7*b* at the bottom of the common discharge chamber 7 and is again compressed together with the refrigerant gas.

By the way, comparing the structure in which the two single compressors are juxtaposed as shown in FIG. 8 with the single multi-compressor shown in FIG. 3, as is apparent from FIGS. 2 and 3, the discharge port 7*a* of the case 1 may be located farther away from the oil separator 5 in the multi-compressor shown in FIG. 3. It is therefore possible to take a longer time for stagnation of the high-pressure refrigerant gas within the case 1. The amount of gravitational drop of the non-separated oil component contained in the high-pressure refrigerant gas is increased. Accordingly, the separation ability of the oil is higher in the multi-compressor.

Also, in the single multi-compressor shown in FIG. 3, comparing the case where either one of the two compressor bodies 4 and 4 is operated (one side drive) with the case where the two single compressors each shown in FIG. 8 are juxtaposed and one of them is only operated, the separation ability of the oil is better in the former. This is because the space volume of the interior of the case 1 is larger in the multi-compressor; that is, the common discharge chamber 7 of the multi-compressor corresponds to the two discharge chambers 7 of the single compressors so that the time for stagnation of the high-pressure refrigerant gas within the case body 1 is longer in the multi-compressor than in the single compressors.

Furthermore, in the case where the space volume of the common discharge chamber 7 of the multi-compressor in accordance with this embodiment is enlarged, the time for stagnation of the high-pressure refrigerant gas including the non-separated oil component in the common discharge chamber 7 is further elongated to be temporarily hold. Accordingly, the amount of the gravitational drop of the non-separated oil component contained in the high-pressure refrigerant gas down to the oil pool 7*b* at the bottom of the common discharge chamber 7 is increased. As a result, the amount of entrance of the non-separated oil component toward the condenser of the air conditioning system is considerably reduced so that the oil that inherently has nothing to do with the refrigeration is prevented from being recirculated through the air conditioning system. It is therefore possible to suppress the oil circulation ratio of the air conditioning system to a lower level and to enhance the refrigeration efficiency. Also, it is possible to reserve a sufficient amount of oil within the gas compressor and it is possible to prevent the lubrication fault of the gas compressor due to the oil shortage.

Figure 5:
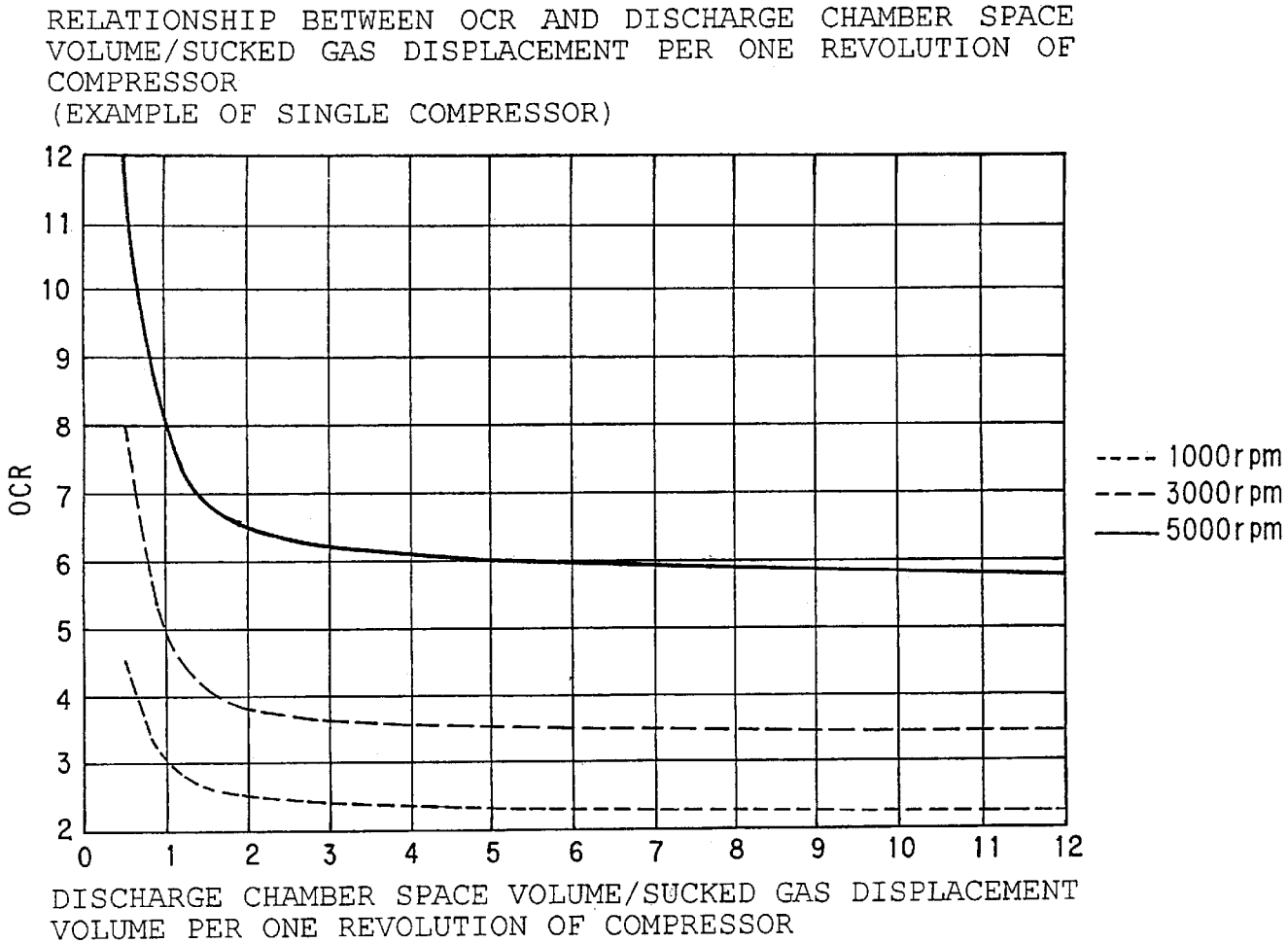
FIG. 5 is a graph showing a relationship between an OCR and a ratio of a discharge chamber space volume relative to a sucked gas displacement volume per one revolution of the single compressor shown in FIG. 1.
Figure 6:
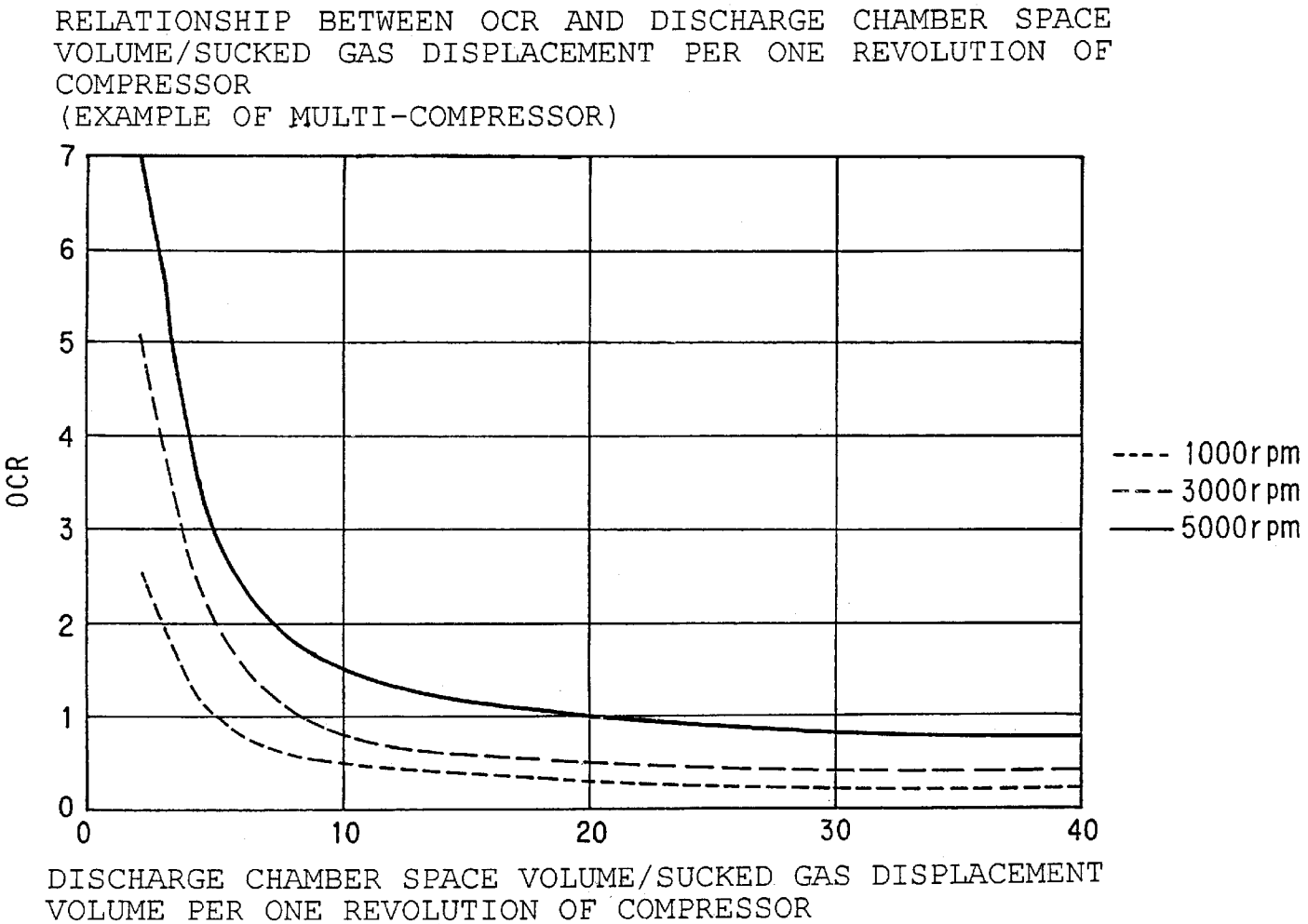
FIG. 6 is a graph showing a relationship between an OCR and a ratio of a discharge chamber space volume relative to a sucked gas displacement volume per one revolution of the multi-compressor shown in FIG. 3.

FIG. 5 shows, in the case of the single compressor, a relationship between the OCR (oil circulated ratio) and a ratio of the discharge chamber space volume to the sucked gas displacement volume per one revolution of the compressor (discharge chamber space volume/sucked gas displacement volume per one revolution of the compressor). FIG. 6 shows, in the case of the multi-compressor, a relationship of the OCR and a ratio of the discharge chamber space volume to the sucked gas displacement volume per one revolution of the compressor. The combination of the oil with the refrigerant gas is PAG system oil and R22 refrigerant in both FIG. 5 and FIG. 6.

It should be noted here that, with reference to FIG. 1, the sucked gas displacement volume per one revolution of the compressor means a theoretical volume of the low pressure refrigerant gas, to be sucked from the suction chamber 6 to the compressor body 4 during one revolution of the rotor 4*b*, which may be calculated in accordance with a dimension and a structure of the compressor body 4. Also, as described above, the OCR means the ratio of the oil component amount relative to the entire amount of the mixture of the refrigerant gas component and the oil component at any desired position within the air conditioning system except for the compressor when a part of the oil filled within the compressor is discharged to the air conditioning system by the operation of the compressor. In general, the OCR is actually measured at a portion kept in a high-pressure liquid state of the refrigerant between the condenser and the expansion valve.

By the way, it is desirable that the OCR is equal to or less than a predetermined value. Namely, in, for example, the evaporator of the air conditioning system, the heat exchange is performed by causing the liquefied refrigerant condensed in the condenser from the side of the gas compressor and expanded (pressure reduction) by the expansion valve to pass through the pipe. However, in the case where the OCR is too large, it is considered that the heat transfer between the liquefied refrigerant and the wall of the pipe is hindered by a thick oil film generated on an inner wall of the pipe of the evaporator due to the excessive mixture of the amount of oil and the heat exchange efficiency would be reduced.

In view of the above-described relationship between the magnitude of the OCR and the heat exchange efficiency of the air conditioning system, in experiments, it has been found that the OCR is suitable in the range of 4% or less, that is, it may render the heat exchange efficiency of the air conditioning system to be the highest. In addition, since the multi-compressor is used in the air conditioning system into which an amount of refrigerant that is several times to several tens of times larger than that of the single compressor is sealed, in view of the cost for the sealed oil and the amount of the oil that may be sealed in the air conditioning system in an actual design, it has been found that the OCR is suitable at one percent or less. Also, although the OCR is varied in accordance with an rpm of the gas compressor, since the normal rpm of the gas compressor is around 3000 rpm, it is important that the OCR becomes suitable around this rpm.

In view of the above, as is apparent from FIG. 5, in the single compressor, in the case where the rpm is at 3,000 rpm, the OCR becomes suitable at 4% or less when the space volume of the discharge chamber 7 is two times larger than the sucked gas displacement volume per one revolution of the compressor or more. Also, as is apparent from FIG. 6, in the multi-compressor, in the case where the rpm is at 3,000 rpm, the OCR becomes suitable at one percent or less when the space volume of the discharge chamber 7 is ten times larger than the sucked gas displacement volume per one revolution of the compressor or more. Namely, in order to render the OCR to be suitable, the larger the space volume of the discharge chamber 7, the better the result will become. However, if the OCR is too large, the manufacture cost will be increased or the handling will be inconvenient in actually manufacturing the compressor and mounting it in the air conditioning system. In view of these factors, in the single compressor, it is most preferable that the space volume of the discharge chamber 7 is two times to ten times larger than the sucked gas displacement volume per one revolution of the compressor, and in the multi-compressor, it is most preferable that the space volume of the discharge chamber 7 is ten times to thirty times larger than the sucked gas displacement volume per one revolution of the compressor.

Also, the OCR is varied in accordance with solubility between the oil and the refrigerant gas. Namely, in the case where the refrigerant gas is likely to be soluble into the oil, it is difficult to separate the gas component and the oil component even by the oil separator 5 provided in the gas compressor and the OCR within the air conditioning system tends to be high. Inversely, when the refrigerant gas is hardly dissoluble into the oil, it is easy to separate the gas component and the oil component by the oil separator 5 provided in the gas compressor and the OCR is likely to be low within the air conditioning system. Accordingly, in order to decrease the OCR, it is considered that the oil into which the refrigerant gas is hardly dissolved is selected in correspondence with the refrigerant gas to be used. However, in the case where the refrigerant gas is hardly soluble into the oil, although the amount of the oil component to be discharged into the air conditioning system 8 from the gas compressor is small per unit time, the state is at low pressure and low temperature from the outlet of the expansion valve 10 to the interior of the evaporator 11 so that the viscosity of the oil that has not been dissolved into the refrigerant gas is raised and the oil is hardly returned to the gas compressor, disadvantageously. Unless the oil is returned to the gas compressor, the amount of the oil in the oil pool 7*b* for lubrication of the compressor body 4 is decreased in accordance with the lapse of the operation time, resulting in the lubrication shortage for the compressor body 4.

Figure 7:
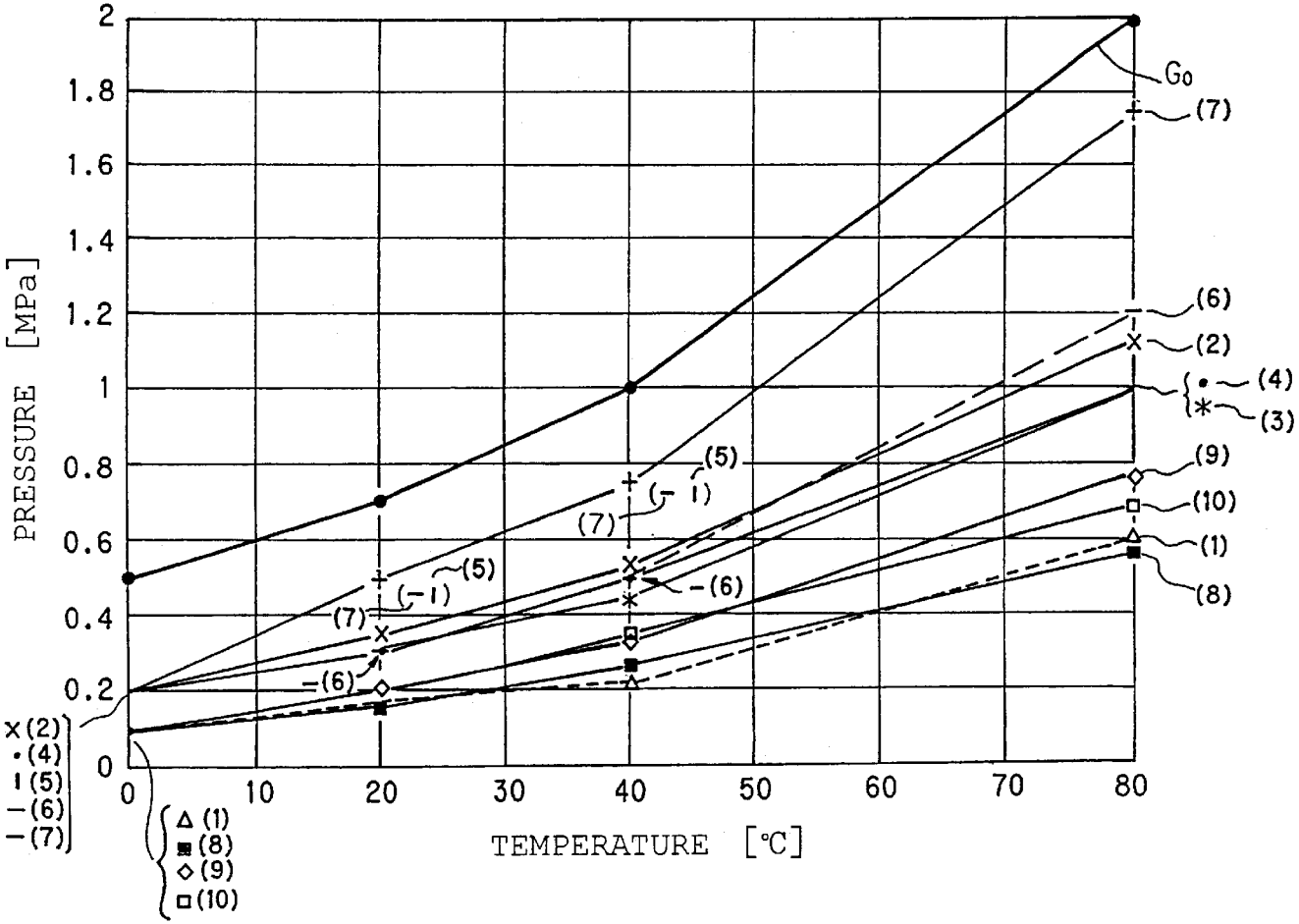
FIG. 7 is a graph showing a relationship between temperature and pressure due to differences in combination of the refrigerant gas and oil when the refrigerant gas is dissolved into the oil by 10%.

Accordingly, in order to obtain an optimum OCR without any lubrication shortage of the compressor body 4, it is important to separate the refrigerant gas component and the oil component within the gas compressor as much as possible and at the same time to establish the relationship that the refrigerant gas and the oil are soluble with each other. Here, FIG. 7 shows a relationship between the temperature and the pressure due to the difference in combination of the refrigerant gas and the oil when the refrigerant gas is dissolved into the oil by 10%. In FIG. 7, a line indicated by Go represents a border at which it is easy or difficult for the oil to return to the gas compressor in the case where the refrigerant gas is dissolved into the oil by 10%, and shows a relationship between the temperature and the pressure on the basis of which the decision is made for use of the combination of the refrigerant gas and the oil. Namely, in the combination of the refrigerant gas and the oil in which the refrigerant gas is dissolved by 10% into the oil in the range exceeding the reference value Go (the left upper region of the line indicated by Go), in particular, the pressure and temperature at the low pressure and low temperature portion of the evaporator or the like of the air conditioning system are plotted in the right lower region of the line indicated by Go. As a result, the refrigerant gas is dissolved into the oil only by less than 10%. This shows that the viscosity of the oil is increased and it is difficult for the oil to return to the gas compressor. Inversely, in the combination of the refrigerant gas and the oil in which the refrigerant gas is dissolved by 10% into the oil in the range equal to or less than the reference value Go (the right lower region of the line indicated by Go), the refrigerant gas is dissolved into the oil by 10% or more even in the low pressure low temperature portion of the evaporator or the like. This shows that it is easy for the refrigerant gas to be dissolved and it is easy for the oil to return to the gas compressor.

A variety of combinations of the oil and the refrigerant gas may be proposed. For instance, as shown in FIG. 7, the easily soluble combinations equal to or less than the reference value Go shown in FIG. 7 are: (1) PAG (polyalkylene glycol) 1 oil that is PAG system oil and R22 refrigerant, (2) PAG 2 oil that is the PAG system oil and R407 refrigerant, (3) ether oil 1 that is ether system oil and R407C refrigerant, (4) carbonate 1 oil that is carbonate system oil and R407C refrigerant, (5) carbonate 2 oil that is carbonate system oil and R410a refrigerant, (6) ester oil 1 that is ester system oil and R407C refrigerant, (7) ester 2 oil that is ester system oil and R410a refrigerant, (7) PAG 2 oil that is PAG system oil and R134a refrigerant, (9) PAG 3 oil that is PAG system oil and R134a refrigerant, and (10) PAG 4 oil that is PAG system oil and R134a refrigerant. As is apparent from FIG. 7, it is understood that in particular the combinations (1) and (8) are most easily soluble combinations out of these combinations. Incidentally, although not shown in FIG. 7, the combinations of paraffin system oil and R22 refrigerant, naphthene system oil and R134a refrigerant, and alkylbenzene system oil and R407C refrigerant may be enumerated as the combinations difficult to be dissolved between the oil and the refrigerant gas exceeding the reference value Go.

Incidentally, in the foregoing embodiment, the multi-compressor provided with two compressor bodies has been described but it is apparent that the present invention may be applied to a multi-compressor having two or more compressor bodies.

In the gas compressor according to the present invention, as described above, the space volume of the discharge chamber is enlarged to a large volume enough to keep the sufficient amount of oil within the gas compressor and to suppress the oil circulated ratio of the air conditioning system. For this reason, the time for stagnation of the refrigerant gas including the oil component that could not be separated by the oil separator (non-separated oil component) in the discharge chamber is elongated. Accordingly, the ratio of the non-separated oil component to drop by gravitational force down to the oil pool at the bottom of the discharge chamber is increased and the entrance amount of the non-separated oil toward the condenser of the air conditioning system is considerably reduced. As a result, a large amount of the oil that inherent has nothing to do with the refrigeration would not be circulated within the air conditioning system to enhance the refrigeration efficiency. Also, even with the combination in which the refrigerant gas is easy to be dissolved into and difficult to be separated from the oil, it is possible to suppress the oil circulated ratio within the air conditioning system and to reserve a sufficient amount of oil within the gas compressor to thereby prevent the lubrication fault of the gas compressor due to the oil shortage.

What is claimed is:

1. A gas compressor comprising: a compressor body for drawing in a low-pressure refrigerant gas, compressing the low-pressure refrigerant gas, and discharging the compressed refrigerant gas at a high pressure together with a lubrication oil for lubricating the compressor body; an oil separator for separating the high-pressure refrigerant gas and the lubrication oil discharged from the compressor body into a gas component and an oil component; and a one piece, unitary compressor casing receiving therein the compressor body and the oil separator, the compressor casing having a barrel portion surrounding an outer portion of the compressor body and an enlarged case portion extending from the barrel portion and having a discharge chamber disposed between an inner surface of the casing and a rear portion of the compressor body for temporarily holding the gas component and the oil component separated by the oil separator, the enlarged case portion having a diameter greater than that of the barrel portion.

2. A gas compressor according to claim 1; wherein the discharge chamber has a discharge port for discharging the gas component to an air conditioning system and oil sump dimensioned to store a sufficient amount of the oil component to suppress an increase in an oil circulation ratio of the air conditioning system and to maintain a sufficient amount of lubricating oil in the compressor casing to lubricate the compressor body.

3. A gas compressor according to claim 1; wherein the enlarged case portion of the compressor casing receives the rear portion of the compressor body and has a volume greater than that of the barrel portion of the compressor casing.

4. A gas compressor according to claim 1; wherein the discharge chamber has a volume that is two times to ten times larger than a volume of refrigerant gas drawn in by the gas compressor per one revolution of the compressor body.

5. A gas compressor comprising:

a compressor body for drawing in a low-pressure refrigerant gas, compressing the low-pressure refrigerant gas, and discharging the compressed refrigerant gas at a high pressure together with a lubrication oil for lubricating the compressor body;

an oil separator for separating the high-pressure refrigerant gas and the lubrication oil discharged from the compressor body into a gas component and an oil component; and a compressor casing receiving therein the compressor body and the oil separator, the compressor casing having a barrel portion having a first diameter and surrounding an outer portion of the compressor body and an enlarged case portion having a second diameter greater than the first diameter and extending from the barrel portion, the enlarged case portion having a discharge chamber disposed between an inner surface of the casing and a rear portion of the compressor body for temporarily holding the gas component and the oil component separated by the oil separator, the discharge chamber having a discharge port for discharging the gas component to an air conditioning system and an oil sump dimensioned to store a sufficient amount of the oil component to suppress an increase in an oil circulation ratio of the air conditioning system and to maintain a sufficient amount of lubricating oil in the compressor casing to lubricate the compressor body.

6. A gas compressor according to claim 5; wherein the enlarged case portion of the compressor casing receives the rear portion of the compressor body and has a volume greater than that of the barrel portion of the compressor casing.

7. A gas compressor according to claim 5; wherein the discharge chamber has a volume that is two times to ten times larger than a volume of refrigerant gas drawn in by the gas compressor per one revolution of the compressor body.

8. A gas compressor according to claim 7; wherein the enlarged case portion of the compressor casing receives the rear portion of each of the compressor bodies and has a volume greater than that of the barrel portion of the compressor casing.

9. A gas compressor according to claim 6; wherein the discharge chamber has a volume that is ten times to thirty times larger than a volume of refrigerant gas displaced by the gas compressor per one revolution of each of the compressor bodies.

10. A gas compressor according to claim 6; wherein the oil and the refrigerant gas are selected from the group consisting of PAG system oil and R22 refrigerant, PAG system oil and R407C refrigerant, ether system oil and R407C refrigerant, carbonate system oil and R410a refrigerant, ester system oil and R410a refrigerant, and PAG system oil and R134a refrigerant.

11. A gas compressor comprising: a compressor casing containing a lubricating fluid and having an inner peripheral surface; at least one compressor body disposed in the compressor casing to define a suction chamber between a front portion of the compressor body and the inner peripheral surface of the compressor casing and to define a discharge chamber between a rear portion of the compressor body and the inner peripheral surface of the compressor casing, the compressor body having a rotor for compressing a low-pressure refrigerant gas introduced into the suction chamber and discharging the compressed refrigerant gas together with lubricating fluid at a high pressure; and a lubricating fluid separator for separating the high-pressure refrigerant gas and lubricating fluid discharged from the compressor body into a gas component and a lubricating fluid component; wherein the discharge chamber temporarily holds the gas component and the lubricating fluid component separated by the lubricating fluid separator and has a discharge port for discharging the gas component to an air conditioning system and a lubricating fluid sump dimensioned to store a sufficient amount of the lubricating fluid component to suppress an increase in a lubricating fluid circulation ratio of the air conditioning system and to maintain a sufficient amount of lubricating fluid in the compressor casing to lubricate the compressor body.

12. A gas compressor according to claim 9; wherein the discharge chamber has a volume that is ten times to thirty times larger than a volume of refrigerant gas drawn in by the gas compressor per one revolution of each of the compressor bodies.

13. A gas compressor according to claim 12; wherein the enlarged case portion of the compressor casing receives the rear portion of the compressor body and has a volume greater than that of the barrel portion of the compressor casing.

14. A gas compressor comprising: a compressor casing containing a lubricating fluid and having an inner peripheral surface; at least one compressor body disposed in the compressor casing to define a suction chamber between a front portion of the compressor body and the inner peripheral surface of the compressor casing, the compressor casing having a barrel portion having a first diameter and surrounding an outer portion of the compressor body and an enlarged case portion extending from the barrel portion and having a second diameter greater than the first diameter, the enlarged case portion having a discharge chamber between a rear portion of the compressor body and the inner peripheral surface of the compressor casing, the compressor body having a rotor for compressing a low-pressure refrigerant gas introduced into the suction chamber and discharging the compressed refrigerant gas together with lubricating fluid at a high pressure; and a lubricating fluid separator for separating the high-pressure refrigerant gas and lubricating fluid discharged from the compressor body into a gas component and a lubricating fluid component; wherein the discharge chamber temporarily holds the gas component and the lubricating fluid component separated by the lubricating fluid separator and has a discharge port for discharging the gas component to an air conditioning suystem and a lubricating fluid sump dimensioned to store a sufficient amount of the lubricating fluid component to suppress an increase in a lubricating fluid circulation ratio of the air conditioning system and to maintain a sufficient amount of lubricating fluid in the compressor casing to lubricate the compressor body.

15. A gas compressor according to claim 14; wherein the enlarged case portion of the compressor casing receives the rear portion of the compressor body and has a volume greater than that of the barrel portion of the compressor casing.

16. A gas compressor according to claim 14; wherein the discharge chamber has a volume that is two time to ten times larger than a volume of refrigerant gas drawn in by the gas compressor per one revolution of the rotor.

17. A gas compressor according to claim 14; wherein the lubricating fluid and the refrigerant gas are selected from the group consisting of PAG system oil and R22 refrigerant, PAG system oil and R407C refrigerant, ether system oil and R407C refrigerant, carbonate system oil and R410a refrigerant, ester system oil and R410a refrigerant, and PAG system oil and R134a refrigerant.

18. A gas compressor according to claim 14; wherein the at least one compressor body comprises a plurality of compressor bodies received in the compressor casing, each of the compressor bodies having a rotor for compressing the low- pressure refrigerant gas introduced into the suction chamber and discharging the refrigerant gas at a high pressure together with the lubricating fluid; and wherein the discharge chamber is a single discharge defined between a rear portion of each of the compressor bodies and the inner peripheral surface of the compressor casing.

* * * * *